US006577290B2

(12) United States Patent
Yeo

(10) Patent No.: US 6,577,290 B2
(45) Date of Patent: Jun. 10, 2003

(54) METHOD OF DRIVING LIQUID CRYSTAL DISPLAY

(75) Inventor: Ju Chun Yeo, Kyungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 151 days.

(21) Appl. No.: 09/880,830

(22) Filed: Jun. 15, 2001

(65) Prior Publication Data

US 2002/0084966 A1 Jul. 4, 2002

(30) Foreign Application Priority Data

Dec. 29, 2000 (KR) ..... 2000-85271

(51) Int. Cl.[7] ..... G09G 3/36
(52) U.S. Cl. ..... 345/88; 345/100
(58) Field of Search ..... 345/88, 87, 89, 345/94, 95, 96, 98, 99, 100, 103, 208, 209, 212, 213

(56) References Cited

U.S. PATENT DOCUMENTS 4,855,724 A * 8/1989 Yang ..... 345/88
6,225,967 B1 * 5/2001 Hebiguchi ..... 345/88
6,243,055 B1 * 6/2001 Fergason ..... 345/88

* cited by examiner

*Primary Examiner*—Xiao Wu
(74) *Attorney, Agent, or Firm*—McKenna Long & Aldridge LLP

(57) ABSTRACT

A method of driving a liquid crystal display that is adaptive for improving uniformity in a driving method employing multiplexors of the liquid crystal display. In the method, a gate-driving signal is sequentially applied to the gate lines for a sequential scanning for each line. Data is supplied to the liquid crystal cells with the same color being adjacent to each other in a scanning interval of a first scanning line. An application sequence of data to the liquid crystal cells with the same color being adjacent to each other in a scanning interval of a second scanning line is differentiated from that in a scanning interval of the first scanning line.

25 Claims, 13 Drawing Sheets

PICTURE QUALITY IN THE PRIOR ART

PICTURE QUALITY IN THE PRESENT INVENTION

METHOD OF DRIVING LIQUID CRYSTAL DISPLAY

This application claims the benefit of Korean Patent Application No. 2000-85271, filed on Dec. 29, 2000.

BACKGROUND OF THE INVENTION

1. Field of the Invention

This invention relates to a liquid crystal display, and more particularly to a method of driving a liquid crystal display that is adaptive for improving uniformity in a driving method employing multiplexors of the liquid crystal display.

2. Description of the Related Art

Generally, a liquid crystal display (LCD) uses a pixel matrix arranged in each intersection between gate lines and data lines to thereby display a picture corresponding to a video signal, such as a television signal. Each pixel consists of a liquid crystal cell controlling a quantity of transmitted light in accordance with a data signal, and a thin film transistor (TFT) for switching the data signal to be applied from the data line to the liquid crystal cell. The pixel matrix is positioned between two glass substrates. The LCD includes driving integrated circuits for driving gate lines and data lines.

In the conventional LCD, a driving integrated circuit for driving the data lines applies signals to the data lines using six multiplexors.

FIG. 1 is a block diagram showing a configuration of a conventional data driving integrated circuit for driving a liquid crystal display panel, which includes a multiplexor block 2 connected between a data driver 1 and a liquid crystal display panel 3.

Outputs DL1 to DLn from the data driver 1 are applied to the multiplexor block 2. The multiplexor block 2 multiplexes an applied signal using six multiplexors (MUX's) to sequentially apply the same to the data lines of the liquid crystal display panel 3.

Referring to FIG. 2, the multiplexor block 2 consists of six multiplexors connected to each output DL1 to DLn of the data driver 1. The output DL1 to DLn of the data driver 1 is applied to a source terminal of each multiplexor (MUX) while a gate pulse as shown in FIG. 3 is sequentially applied to a gate terminal of each MUX to thereby turn on the MUX's. Thus, a data signal is stored in a capacitor of the data line via a drain terminal of each MUX. Then, a data signal is charged in a pixel electrode (not shown) just until the gate pulse goes off.

FIG. 3 shows a "turned-on" sequence of six MUX's for applying a gate pulse.

Referring to FIG. 3, data with a first color is supplied to the first liquid crystal cell, one of the first and second liquid crystal cells, and then data with the first color is supplied to the second liquid crystal cell. The first color for the first liquid crystal cell is adjacent to the first color for the second liquid crystal cell, as shown in the first line of FIG. 3. Data with a second color is supplied to the fourth liquid crystal cell of the third and fourth liquid crystal cells and then is supplied to the third liquid crystal cell. Data with a third color is supplied to the fifth liquid crystal cell of the fifth and sixth liquid crystal cells and then is supplied to the sixth liquid crystal cell. Herein, the first color is a red; the second color is a green; and the third color is a blue. In this manner, the MUX's are sequentially turned on to supply data to each liquid crystal cell of the data lines.

Upon driving of the MUX's, a data signal is stored in a capacitor of the data line when a gate pulse is applied to each MUX, while a data signal is charged in the pixel electrode just until the gate pulse turns off. Thus, a voltage difference is generated when the data signal is applied from the data line of the liquid crystal display panel 3 and then is charged in the pixel electrode. The voltage difference between the data lines 3 caused by a charge characteristic difference as shown in FIG. 4.

As can be seen from FIG. 4, a voltage difference as indicated by dotted lines in the figure is generated from voltage waveforms of Data1 to Data6 at a time from turning-on of the gate pulse until turning-off of the gate pulse, that is, at a sampling time. Also, a voltage difference is generated between the data lines due to a leakage current as shown in FIG. 5.

As can be seen from FIG. 5, a voltage difference, as indicated by dotted lines in the figure is generated from voltage waveforms of Data1 to Data6 at a time from turning-on of the gate pulse until turning-off of the gate pulse, that is, at a sampling time. Accordingly, in a six-multiplexor driving scheme, red (R) is applied in MUX1 and MUX2 intervals; green (G) is applied in MUX3 and MUX4 intervals; and blue (G) is applied in MUX5 and MUX6 intervals, to prevent stripe generation caused by coupling between the data lines upon application of data.

Normal-temperature operation of the LCD does not cause stripe generation. However, low-temperature operation or a mobility deterioration of the liquid crystal allows a stripe shape to be generated in the liquid crystal display panel because a charge characteristic difference between the multiplexors exists. Particularly, charge time at the MUX5 and MUX6 is shortest. Moreover, a large leakage current causes problems such as poor picture quality, because the charge time (MUX turn_on through Gate_off), during which a voltage of the data line is charged via the multiplexors, should be held is different depending on which MUX is charged, that is, which MUX number. As a result, a minute voltage difference caused by poor quality of line shape is generated such that it can be easily perceived by a human's eye.

SUMMARY OF THE INVENTION

Accordingly, it is an object of the present invention to provide a method of driving a liquid crystal display that is adaptive for improving uniformity in a driving method employing multiplexors of the liquid crystal display.

In order to achieve these and other objects of the invention, a method of driving a liquid crystal display according to an embodiment of the present invention includes the steps of sequentially applying a gate driving signal to gate lines for a sequential scanning for each line; supplying data to liquid crystal cells with the same color being adjacent to each other in a scanning interval of a first scanning line; and differentiating an application sequence of data to the liquid crystal cells with the same color being adjacent to each other in a scanning interval of a second scanning line from that in a scanning interval of the first scanning line.

The driving method further includes the steps of, at the first line, supplying data to the first liquid crystal cell of the first and second liquid crystal cells with a first color being adjacent to each other and thereafter supplying the data to the second liquid crystal cell; supplying data to the fourth liquid crystal cell of the third and fourth liquid crystal cells with a second color and thereafter supplying the data to the third liquid crystal cell; and supplying data to the fifth liquid crystal cell of the fifth and sixth liquid crystal cells with a third color and thereafter supplying the data to the sixth liquid crystal cell. Herein, first color is a red, a second color is a green, and a third color is a blue.

The driving method further includes the steps of, at the second line, supplying data to the second liquid crystal cell and thereafter supplying the data to the first liquid crystal cell; supplying data to the third liquid crystal cell and thereafter supplying the data to the fourth liquid crystal cell; and supplying data to the sixth liquid crystal cell and thereafter supplying the data to the fifth liquid crystal cell.

A method of driving a liquid crystal display according to another embodiment of the present invention includes the steps of sequentially applying a gate driving signal to gate lines every frame for a sequential scanning for each frame; supplying data to liquid crystal cells with the same color being adjacent to each other in a specific sequence at a first frame of said frames; differentiating an application sequence of data to the liquid crystal cells with the same color being adjacent to each other at a second frame following the first frame from that that at the first frame; equalizing data application sequence at a third frame following the second frame to that at the second frame; equalizing data application sequence at a fourth frame following the third frame to that at the first frame; and periodically repeating data application in said sequences at the first to fourth frames.

The driving method further includes the steps of, at the first frame, supplying data to the first liquid crystal cell of the first and second liquid crystal cells with a first color being adjacent to each other and thereafter supplying the data to the second liquid crystal cell; supplying data to the fourth liquid crystal cell of the third and fourth liquid crystal cells with a second color and thereafter supplying the data to the third liquid crystal cell; and supplying data to the fifth liquid crystal cell of the fifth and sixth liquid crystal cells with a third color and thereafter supplying the data to the sixth liquid crystal cell. Herein, the first color is a red, a second color is a green, and a third color is a blue.

The driving method further includes the steps of, at the second frame, supplying data to the second liquid crystal cell and thereafter supplying the data to the first liquid crystal cell; supplying data to the third liquid crystal cell and thereafter supplying the data to the fourth liquid crystal cell; and supplying data to the sixth liquid crystal cell and thereafter supplying the data to the fifth liquid crystal cell.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 6:
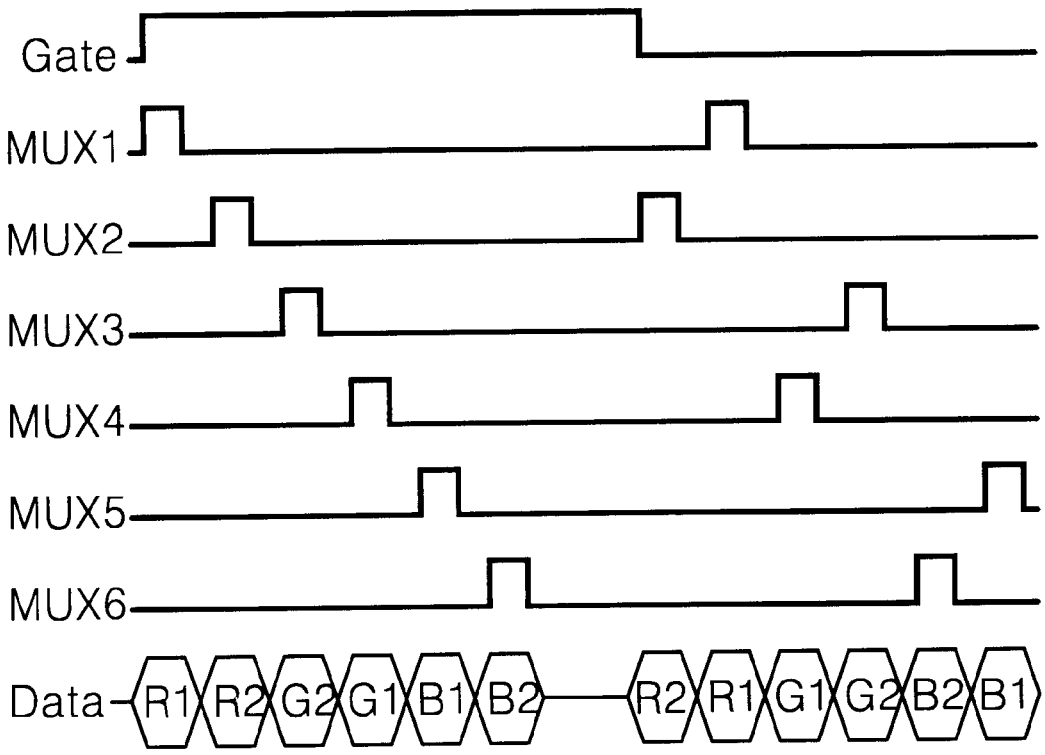
FIG. 6 is a waveform diagram representing turning-on periods of multiplexors of line inversion system according to an embodiment of the present invention.

FIG. 6 is a waveform diagram representing a turning-on sequence of multiplexors of line inversion system according to an embodiment of the present invention.

Referring to FIG. 6, at the first line, data with a first color is supplied to the first liquid crystal cell of the first and second liquid crystal cells, and then is supplied to the second liquid crystal cell. The first color for the first and second liquid crystal cells are adjacent to each other. Data with a second color is supplied to the fourth liquid crystal cell of the third and fourth liquid crystal cells, and then is supplied to the third liquid crystal cell. Data with a third color is supplied to the fifth liquid crystal cell of the fifth and sixth liquid crystal cells, and then is supplied to the sixth liquid crystal cell.

Further, at the second line, data is supplied to the second liquid crystal cell and then supplied to the first liquid crystal cell; data is supplied to the third liquid crystal cell and then supplied to the fourth liquid crystal cell; and data is supplied to the sixth liquid crystal cell and then supplied to the fifth liquid crystal cell. Herein, the first color is a red; the second color is a green; and the third color is a blue. In this manner, the MUX's are sequentially turned on to supply data to each liquid crystal cell of the data lines.

Figure 7:
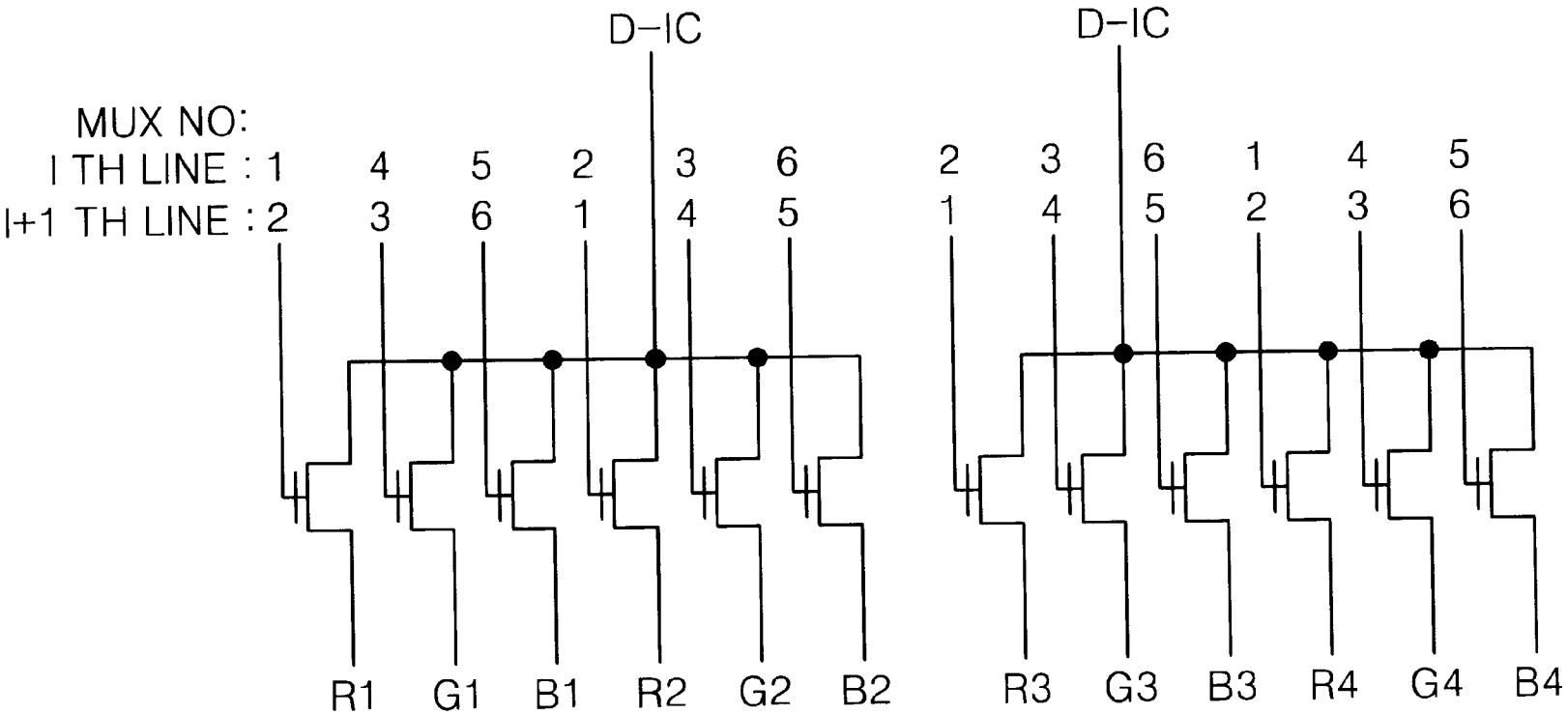
FIG. 7 is a circuit diagram showing a configuration of a multiplexor block according to an embodiment of the present invention.

Referring to FIG. 7, each output DL1 to DLn of the data driver 1 are applied to a source terminal of each MUX, while a gate pulse as shown in FIG. 6 is sequentially applied to a gate terminal of each MUX, to thereby turn on the MUX's. Thus, a data signal is stored in a capacitor of the data line via a drain terminal of each MUX. Then, a data signal is charged in a pixel electrode (not shown) just until the gate pulse turns off.

Upon driving of the MUX's, a data signal is stored in a capacitor of the data line when a gate pulse is applied to each MUX, while a data signal is charged in the pixel electrode just until the gate pulse turns off. Thus, when a data signal is applied from the data line of the liquid crystal display panel 3 and then is charged in the pixel electrode, a voltage difference between the data lines 3 is generated by a charge characteristic difference, as shown in FIG. 8.

Figure 8:
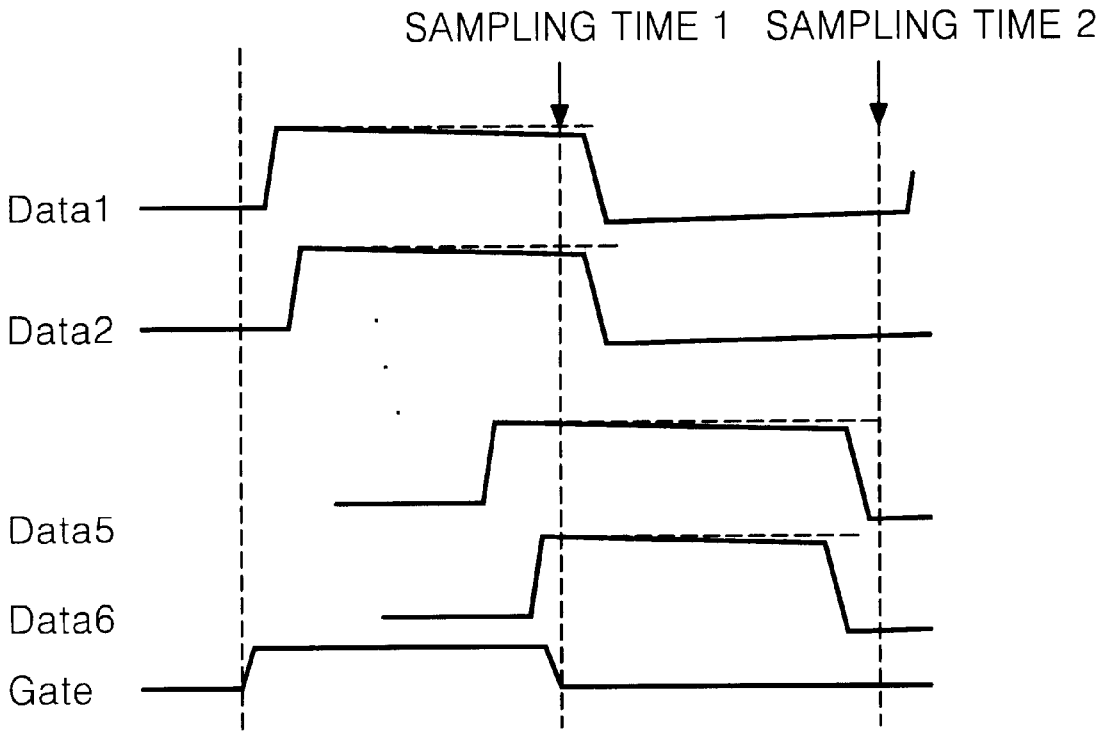
FIG. 8 is a waveform diagram representing a voltage difference between the data lines caused by a leakage current.

As can be seen from FIG. 8, a voltage difference as indicated by dotted lines is generated from voltage waveforms of Data1 to Data6 during a time from turning-on of the gate pulse until turning-off of the gate pulse, that is, at a sampling time 1. Also, a minute voltage difference is generated at a sampling time 2. Further, a voltage difference is generated between the data lines due to a lack of charge as shown in FIG. 9.

Figure 9:
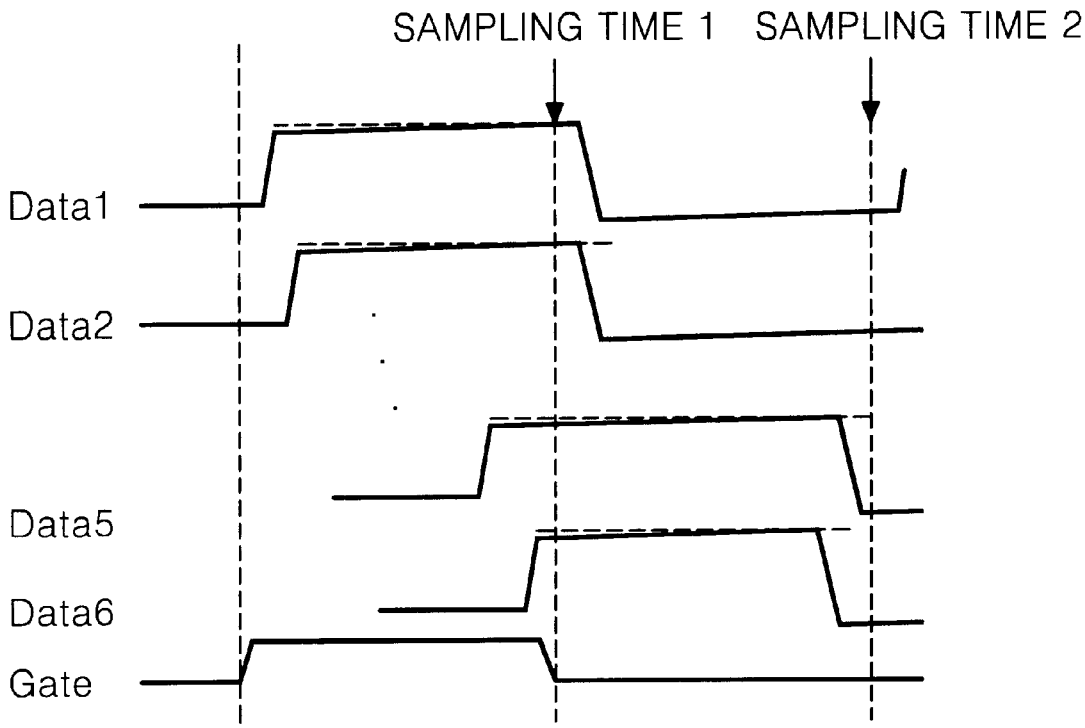
FIG. 9 is a waveform diagram representing a voltage difference between the data lines caused by a charge characteristic difference.

As can be seen from FIG. 9, a voltage difference caused by a lack of charge, as indicated by dotted lines, is generated from voltage waveforms of Data1 to Data6 during the time from turning-on of the gate pulse until turning-off of the gate pulse, that is, at the sampling time 1 and the sampling time 2.

If a turning-on sequence of six MUX's for each line is changed, as shown in FIG. 6, however, then a sequence of the MUX's for each gate line becomes different to eliminate poor picture caused by generation of stripes. In particular, in the high-resolution screen, an average brightness of the adjacent pixels is perceived by a human's eye, so that it becomes possible to obtain a clear picture as shown FIG. 10B, even though a voltage difference between the data lines is generated due to poor charge and leakage current, etc.

Figure 10A:
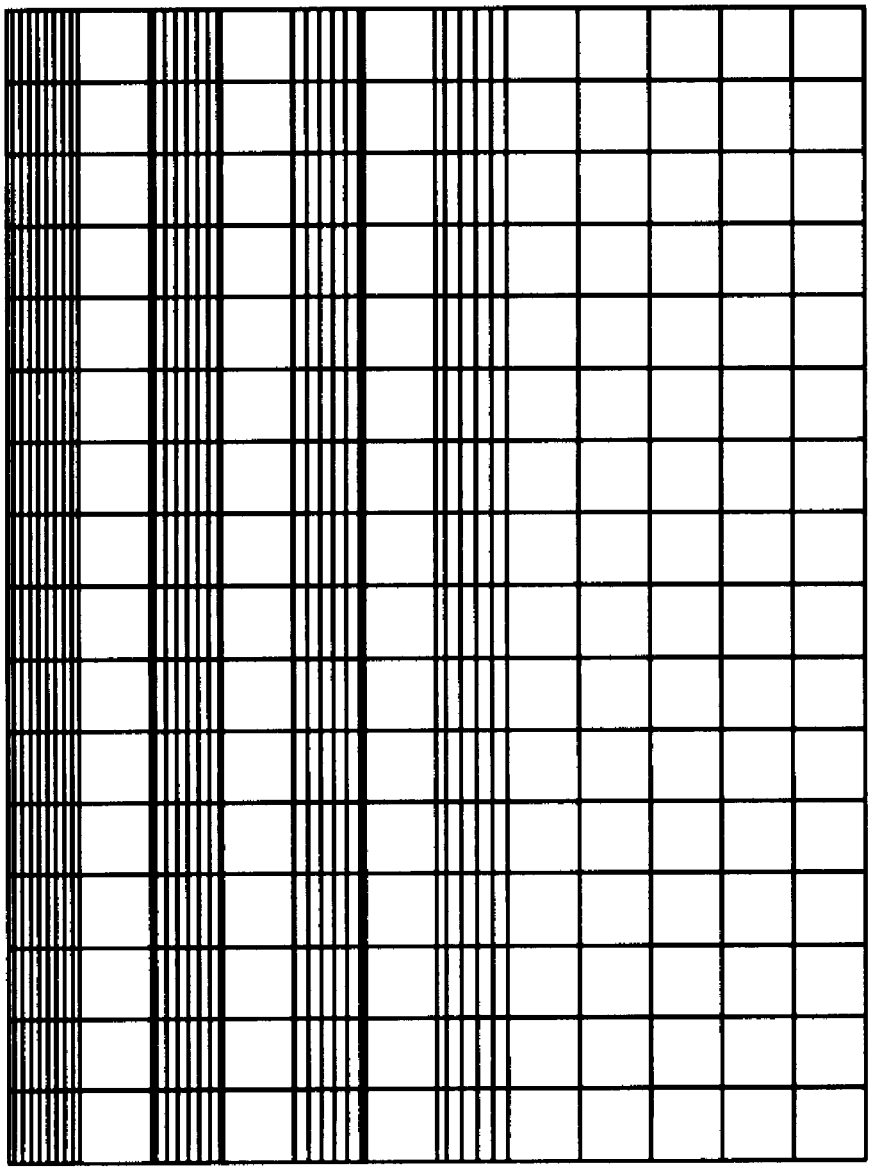
FIG.10A PRIOR ART
FIG. 10A and FIG. 10B are graphs for comparing a picture quality in the present invention with that in the prior art.
Figure 10B:
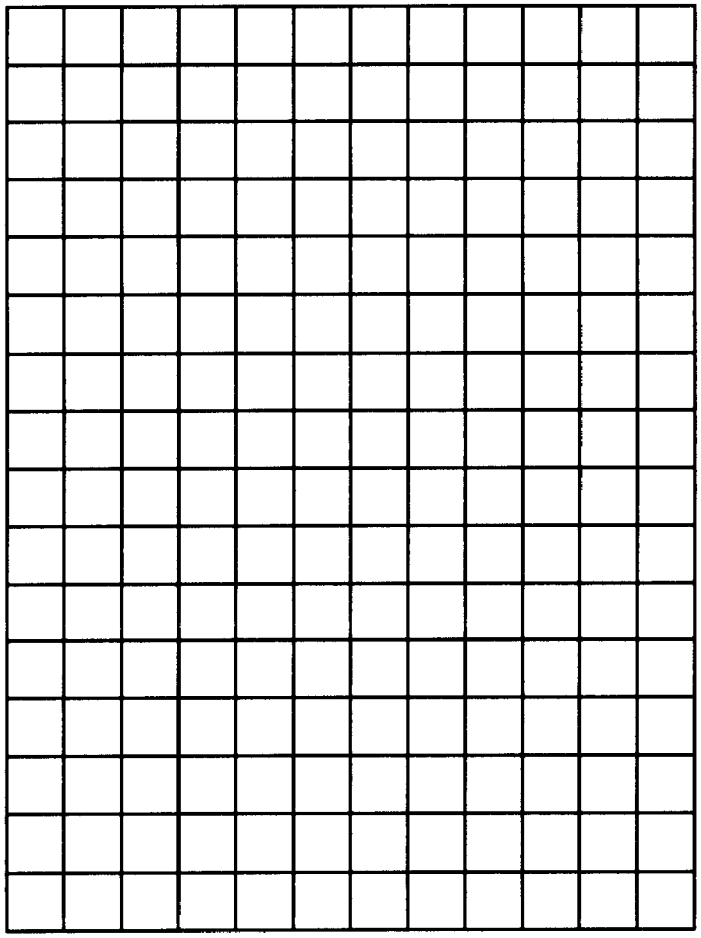
Figure 11A:
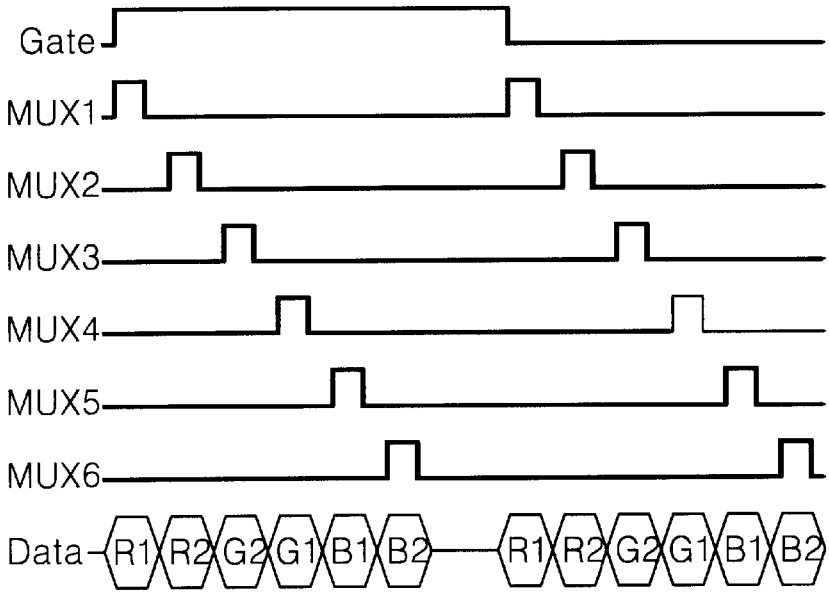
FIG. 11A to FIG. 11D are waveform diagrams representing turning-on periods of multiplexors of frame inversion system according to another embodiment of the present invention.
Figure 11B:
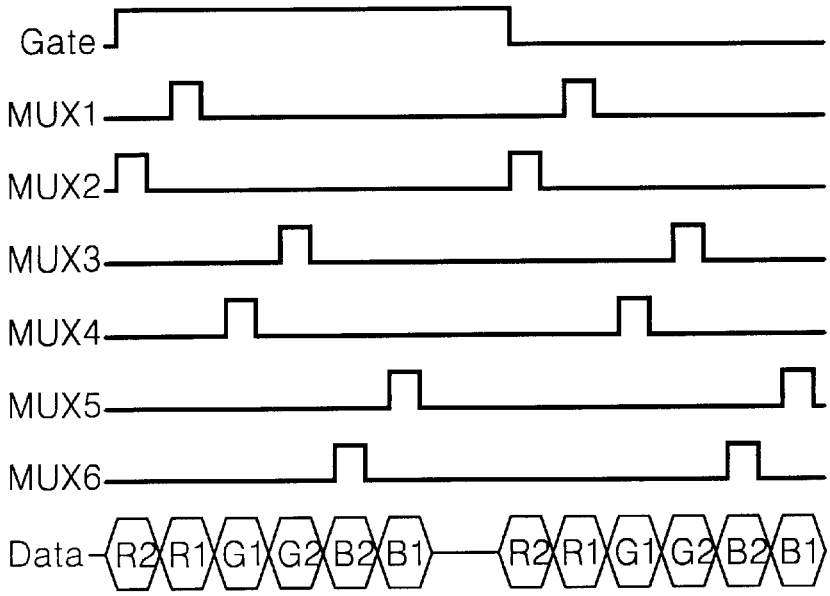
Figure 11C:
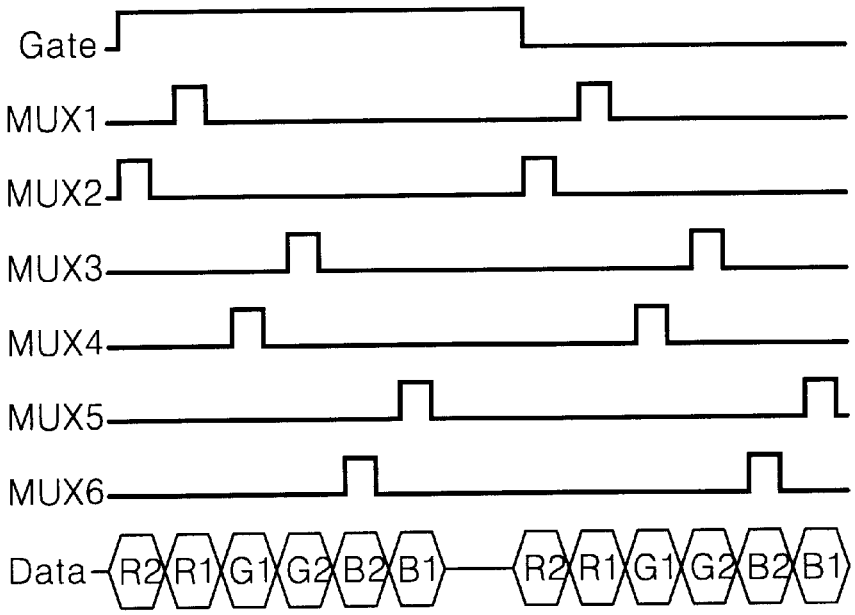
Figure 11D:
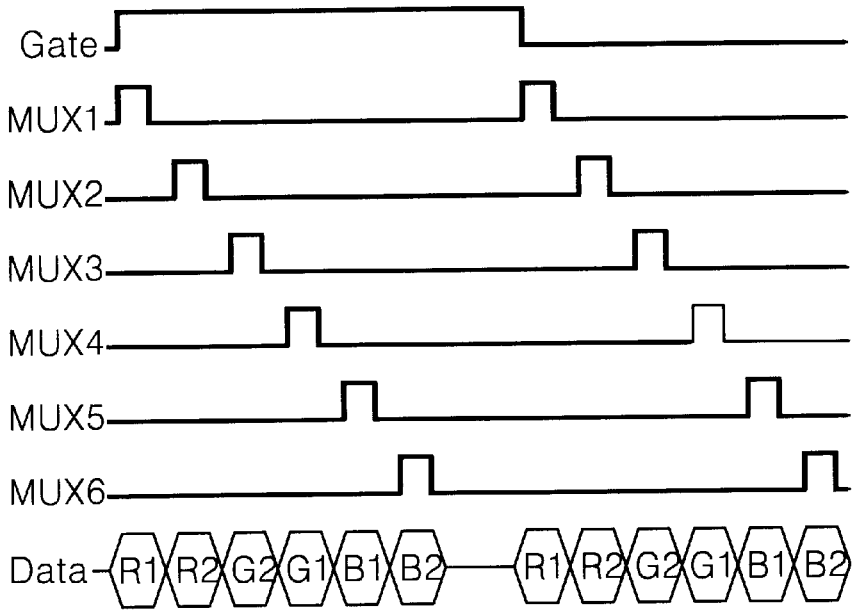

This can be seen from FIG. 10A and FIG. 10B, in which a picture quality in the prior art is compared with that in the present invention. The conventional driving method, as shown in FIG. 10A, displays vertical stripes in the liquid crystal display panel due to a difference in a voltage charged in the pixel electrode. Whereas the present driving method, as shown in FIG. 10B, removes vertical stripes displayed in the liquid crystal display panel in the prior art by changing the turning-on sequence of the MUX's.

FIG. 11A to FIG. 11D show signal waveforms from multiplexors of frame inversion system according to another embodiment of the present invention.

Referring to FIG. 11A to FIG. 11D, at the first frame, data is supplied to the first liquid crystal cell of the first and second liquid crystal cells with a first color being adjacent to each other and then is supplied to the second liquid crystal cell. Data is supplied to the fourth liquid crystal cell of the third and fourth liquid crystal cells with a second color and then is supplied to the third liquid crystal cell. Data is supplied to the fifth liquid crystal cell of the fifth and sixth liquid crystal cells with a third color and then is supplied to the sixth liquid crystal cell.

Further, at the second frame, data is supplied to the second liquid crystal cell and then supplied to the first liquid crystal cell. Data is supplied to the third liquid crystal cell and then supplied to the fourth liquid crystal cell. Data is supplied to the sixth liquid crystal cell and then supplied to the fifth liquid crystal cell. In the mean time, a data application sequence of the third frame is identical to that of the second frame, while a data application sequence of the fourth frame is identical to that of the first frame. Herein, the first color is a red; the second color is a green; and the third color is a blue.

As described above, data is periodically applied to the liquid crystal cells at four frames, so that vertical stripes displayed on the liquid crystal display panel in the prior art can be removed to thereby obtain a clean picture.

Figure 12:
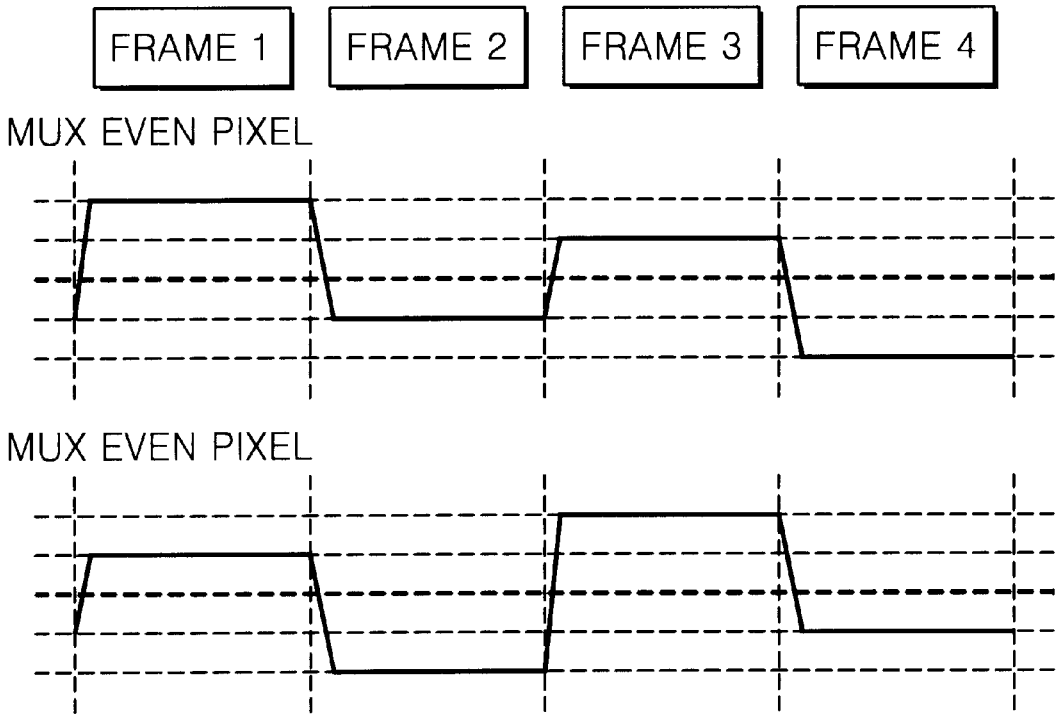
FIG. 12 is a waveform diagram representing voltage signals for each of odd-numbered and even-numbered pixels of the multiplexors to be applied to the liquid crystal display.

FIG. 12 is a waveform diagram of signals applied to the odd-numbered and even-numbered liquid crystal cells of the LCD by means of the MUX's.

Figure 1:
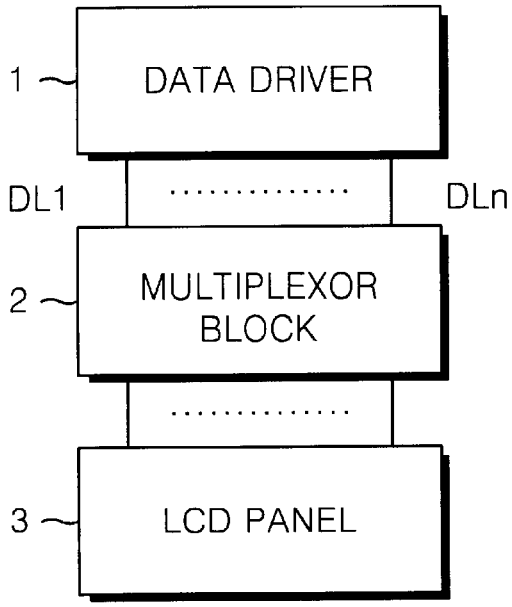
FIG. 1 CONVENTIONAL ART
FIG. 1 is a schematic block diagram showing a configuration of a conventional driving apparatus for data lines of a liquid crystal display panel.
Figure 2:
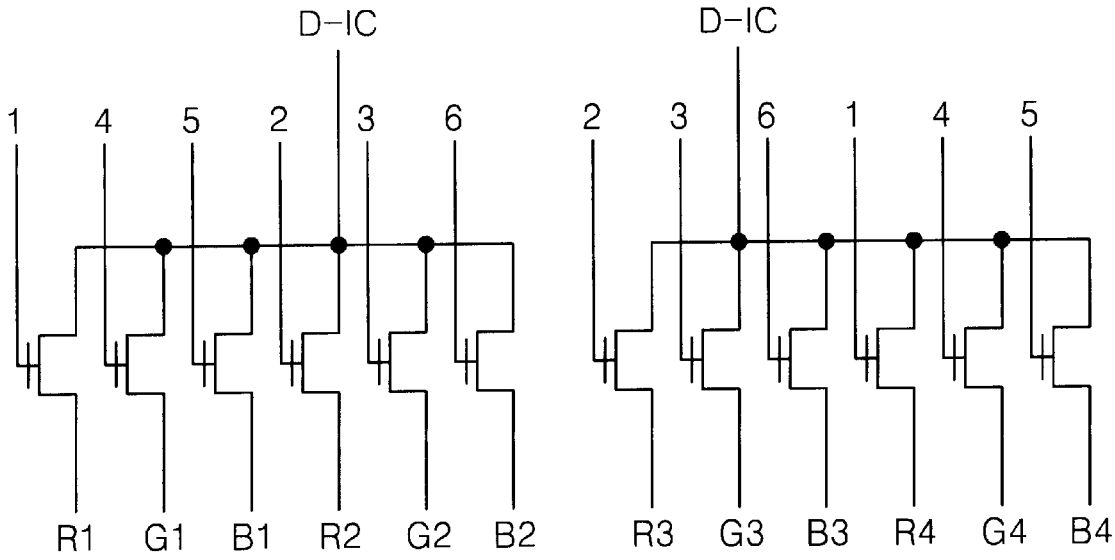
FIG. 2 CONVENTIONAL ART
FIG. 2 is a circuit diagram of the multiplexor block shown in FIG. 1.
Figure 3:
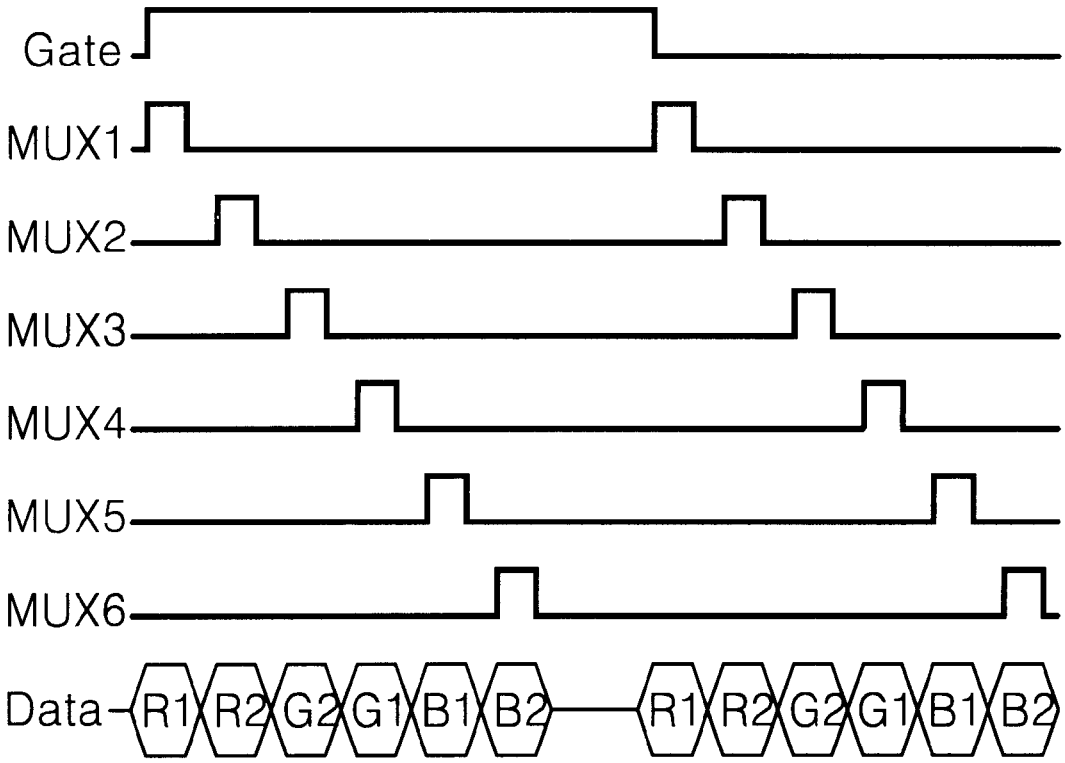
FIG.3 CONVENTIONAL ART
FIG. 3 is a waveform diagram representing turning-on periods of the multiplexors.
Figure 4:
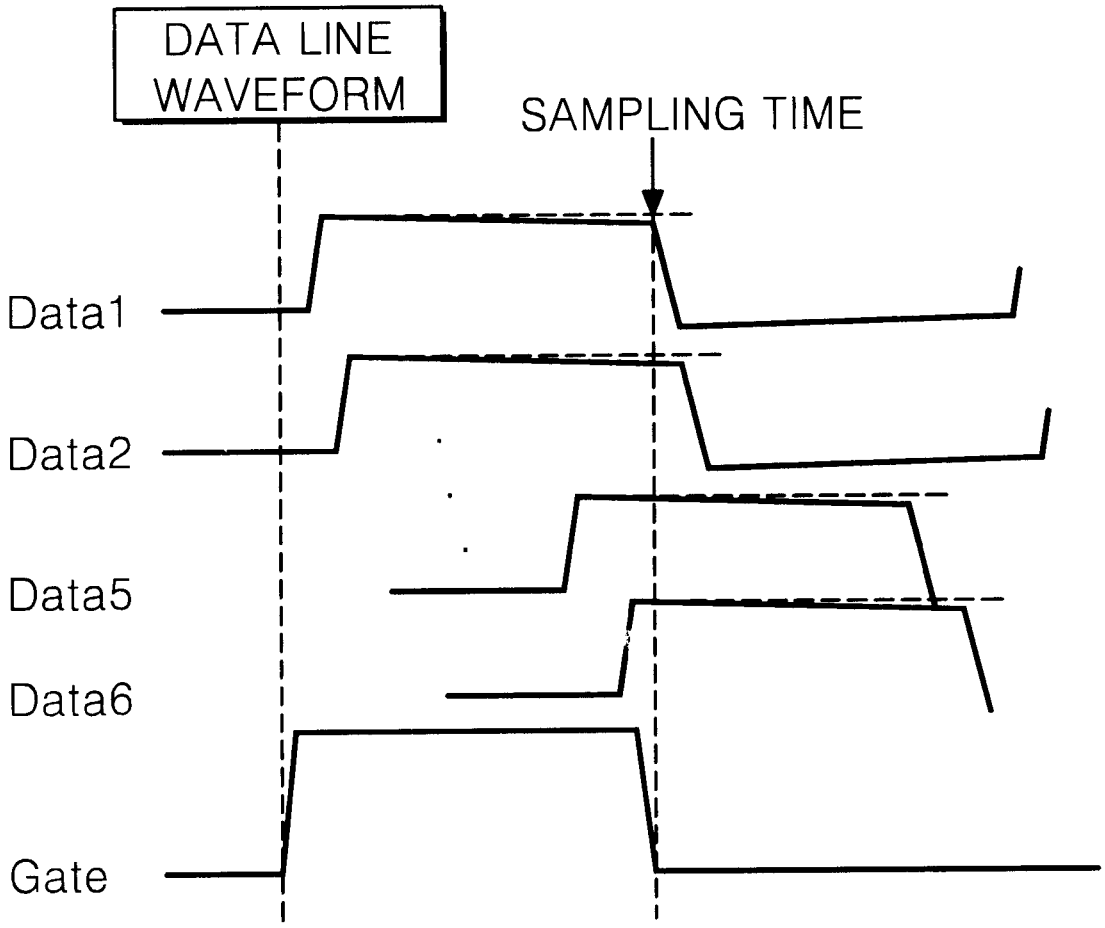
FIG. 4 CONVENTIONAL ART
FIG. 4 is a waveform diagram representing a voltage difference between the data lines caused by a leakage current.
Figure 5:
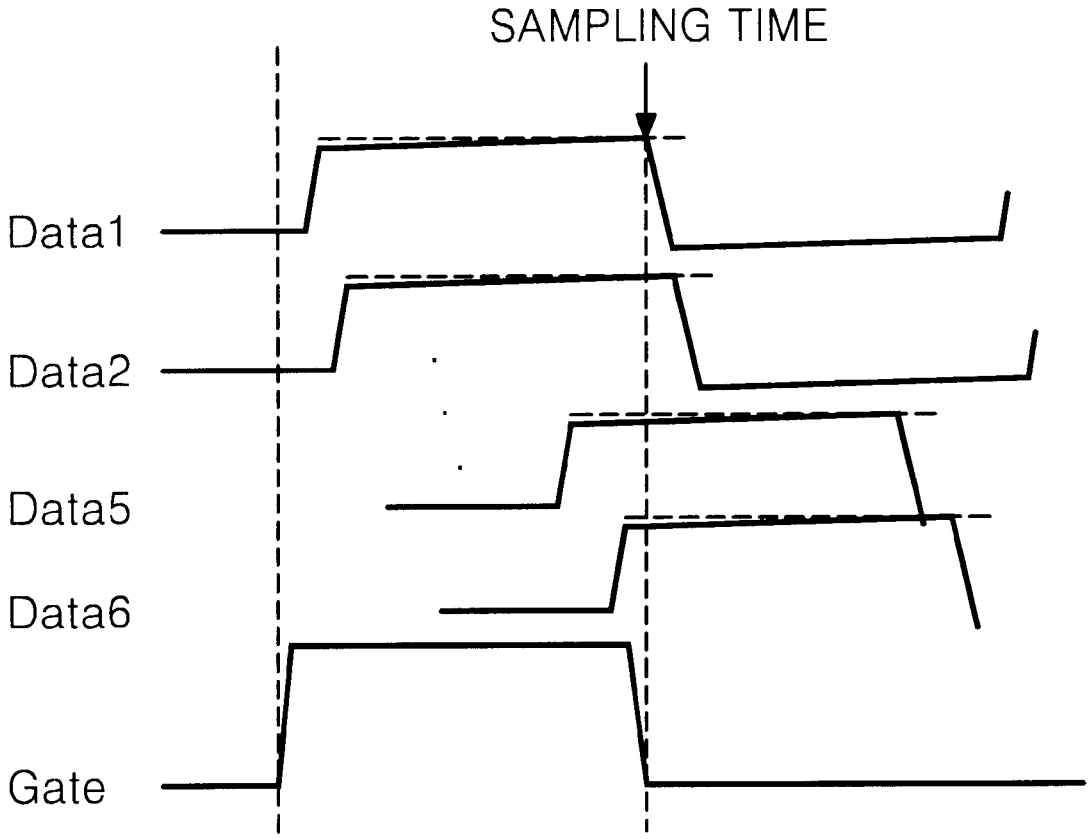
FIG. 5 CONVENTIONAL ART
FIG. 5 is a waveform diagram representing a voltage difference between the data lines caused by a charge characteristic difference.

If a turning-on sequence of the MUX's is changed every frame, as shown in FIG. 2, then the signals has a strong effective voltage upon averaging of the first to fourth frames. Even though a difference in voltages charged in the pixel electrode within each frame occurs, the voltage differences are averaged on a time basis to obtain a visually uniform picture. In this case, a repetition of our frames aims at preventing a generation of direct current offset voltage from each pixel.

As a result, a method of driving the LCD according to the present invention changes a turning-on sequence of the MUX's every frame or every line, thereby reducing a voltage unbalance between the data lines that may be generated due to a charge characteristic difference and a leakage current by a so-called averaging effect.

As described above, according to the present invention, a turning-on sequence of the multiplexors is changed every frame or every line in consideration of a poor picture quality, such as a stripe-shape display, caused by a characteristic difference between the multiplexors in the prior art upon low-temperature operation or deterioration of mobility. Thus, vertical stripes generated on the liquid crystal display panel can be removed to thereby permit a picture expression with no distortion.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a liquid crystal display having liquid crystal cells arranged between gate lines and data lines in a matrix type, said method comprising the steps of:

sequentially applying a gate-driving signal to the gate lines for a sequential scanning for each line;

supplying a data to the liquid crystal cells with the same color being adjacent to each other in a scanning interval of a first scanning line; and differentiating an application sequence of a data to the liquid crystal cells with the same color being adjacent to each other in a scanning interval of a second scanning line from that in a scanning interval of the first scanning line.

2. The method as claimed in claim 1, further comprising the steps of:

at the first line, supplying a data to the first liquid crystal cell of the first and second liquid crystal cells with a first color being adjacent to each other and thereafter supplying the data to the second liquid crystal cell;

supplying a data to the fourth liquid crystal cell of the third and fourth liquid crystal cells with a second color and thereafter supplying the data to the third liquid crystal cell; and supplying a data to the fifth liquid crystal cell of the fifth and sixth liquid crystal cells with a third color and thereafter supplying the data to the sixth liquid crystal cell.

3. The method as claimed in claim 2, wherein the first color is a red, a second color is a green, and a third color is a blue.

4. The method as claimed in claim 2, further comprising the steps of:

at the second line, supplying a data to the second liquid crystal cell and thereafter supplying the data to the first liquid crystal cell;

supplying a data to the third liquid crystal cell and thereafter supplying the data to the fourth liquid crystal cell; and supplying a data to the sixth liquid crystal cell and thereafter supplying the data to the fifth liquid crystal cell.

5. The method as claimed in claim 4, wherein the first color is a red, a second color is a green, and a third color is a blue.

6. A method of driving a liquid crystal display having liquid crystal cells arranged between gate lines and data lines in a matrix type that employs a polarity inversion for each frame, said method comprising the steps of:

sequentially applying a gate-driving signal to the gate lines every frame for a sequential scanning for each frame;

supplying a data to the liquid crystal cells with the same color being adjacent to each other in a specific sequence at a first frame of said frames;

differentiating an application sequence of a data to the liquid crystal cells with the same color being adjacent to each other at a second frame following the first frame from that that at the first frame;

equalizing a data application sequence at a third frame following the second frame to that at the second frame;

equalizing a data application sequence at a fourth frame following the third frame to that at the first frame; and periodically repeating a data application in said sequences at the first to fourth frames.

7. The method as claimed in claim 6, further comprising the steps of:

at the first frame, supplying a data to the first liquid crystal cell of the first and second liquid crystal cells with a first color being adjacent to each other and thereafter supplying the data to the second liquid crystal cell;

supplying a data to the fourth liquid crystal cell of the third and fourth liquid crystal cells with a second color and thereafter supplying the data to the third liquid crystal cell; and supplying a data to the fifth liquid crystal cell of the fifth and sixth liquid crystal cells with a third color and thereafter supplying the data to the sixth liquid crystal cell.

8. The method as claimed in claim 7, wherein the first color is a red, a second color is a green, and a third color is a blue.

9. The method as claimed in claim 7, further comprising the steps of:

at the second frame, supplying a data to the second liquid crystal cell and thereafter supplying the data to the first liquid crystal cell;

supplying a data to the third liquid crystal cell and thereafter supplying the data to the fourth liquid crystal cell; and supplying a data to the sixth liquid crystal cell and thereafter supplying the data to the fifth liquid crystal cell.

10. The method as claimed in claim 9, wherein the first color is a red, a second color is a green, and a third color is a blue.

11. A method of driving a liquid crystal display having liquid crystal cells arranged between gate lines and data lines in a matrix type, said method comprising:

sequentially applying a gate-driving signal to the gate lines for a sequential scanning for each data line;

supplying a first sequence of data to the liquid crystal cells with a same color being adjacent to each other in a scanning interval of a first scanning line; and supplying a second sequence of data to the liquid crystal cells with a same color being adjacent in a scanning interval of a second scanning line, the second sequence of the data being different from the first sequence of data.

12. The method of claim 11, wherein the supplying a first sequence of data to the liquid crystal cells include:

supplying first data with a first color to a first liquid crystal cell of first and second liquid crystal cells and thereafter supplying the first data to the second liquid crystal cell;

supplying second data with a second color to a fourth liquid crystal cell of third and fourth liquid crystal cells and thereafter supplying the second data to the third liquid crystal cell; and supplying third data with a third color to a fifth liquid crystal cell of fifth and sixth liquid crystal cells and thereafter supplying the third data to the sixth liquid crystal cell.

13. The method of claim 12, wherein the first color is red, the second color is green, and the third color is blue.

14. The method of claim 12, wherein supplying a second sequence of data includes:

supplying fourth data with the first color to the second liquid crystal cell and thereafter supplying the fourth data to the first liquid crystal cell;

supplying fifth data with the second color to the third liquid crystal cell and thereafter supplying the fifth data to the fourth liquid crystal cell; and supplying sixth data with the third color to the sixth liquid-crystal cell and thereafter supplying the sixth data to the fifth liquid crystal cell.

15. The method of claim 14, wherein the first color is red, the second color is green, and the third color is blue.

16. A method of driving a liquid crystal display having liquid crystal cells arranged between gate lines and data lines in a matrix type that employs a polarity inversion for each of a plurality of frames, said method comprising:

sequentially applying a gate-driving signal to the gate lines every frame;

supplying a sequence of first data to the liquid crystal cells with the same color being adjacent to each other in a specific sequence at a first frame of said frames;

supplying a sequence of a second data to the liquid crystal cells with the same color being adjacent to each other at a second frame, the sequence of first data being different from the sequence of second data;

supplying a sequence of third data at a third frame following the second frame, the sequence of third data being substantially the same as the sequence of second data;

supplying a sequence of fourth data at a fourth frame following the third frame, the sequence of fourth data being substantially the same as the sequence of first data; and periodically repeating a data application in said sequences at the first to fourth frames.

17. The method of claim 16, further comprising the steps of wherein supplying a sequence of first data at a first frame includes:

supplying first color data to the first liquid crystal cell of the first and second liquid crystal cells with a first color being adjacent and thereafter supplying the first color data to the second liquid crystal cell;

supplying second color data to the fourth liquid crystal cell of the third and fourth liquid crystal cells with a second color being adjacent and thereafter;

supplying the second color data to the third liquid crystal cell; and supplying third color data to the fifth liquid crystal cell of the fifth and sixth liquid crystal cells with a third color being adjacent and thereafter supplying the third data to the sixth liquid crystal cell.

18. The method of claim 17, wherein the first color is red, the second color is green, and the third color is blue.

19. The method of claim 17, wherein supplying a sequence of second data includes:

supplying first color data to the second liquid crystal cell and thereafter supplying the first color data to the first liquid crystal cell;

supplying second color data to the third liquid crystal cell and thereafter supplying the second color data to the fourth liquid crystal cell; and supplying third color data to the sixth liquid crystal cell and thereafter supplying the data to the fifth liquid crystal cell.

20. The method of claim 19, wherein the first color is red, the second color is green, and the third color is blue.

21. A method of driving a liquid crystal display having liquid crystal cells arranged between gate lines and data lines in a matrix type that employs a polarity inversion for each of a plurality of frames, said method comprising the steps of:

sequentially applying a gate-driving signal to the gate lines every frame;

supplying a first sequence of data to the liquid crystal cells with the same color being adjacent to each other in a specific sequence at a first frame of said frames;

supplying a second sequence of data to the liquid crystal cells, the second sequence being different from the first sequence;

supplying a third sequence of data to the liquid crystal cells at a third frame following the second frame, the third sequence of data being substantially the same as the second sequence of data;

supplying a fourth sequence of data to the liquid crystal cells at a fourth frame following the third frame, the fourth sequence of data being substantially the same as the first sequence of data; and periodically repeating data application in said sequences at the first to fourth frames.

22. The method as claimed in claim 21, wherein supplying a first sequence of data includes:

at the first frame, supplying first color data to a first liquid crystal cell of first and second liquid crystal cells and thereafter supplying the first color data to a second liquid crystal cell;

supplying second color data to a fourth liquid crystal cell of third and fourth liquid crystal cells with a second color and thereafter supplying the second color data to the third liquid crystal cell; and supplying third color data to a fifth liquid crystal cell of fifth and sixth liquid crystal cells with a third color and thereafter supplying the third color data to the sixth liquid crystal cell.

23. The method as claimed in claim 22, wherein the first color is red, the second color is green, and the third color is blue.

24. The method as claimed in claim 22, wherein supplying a second sequence of data includes:

at the second frame, supplying first color data to a second liquid crystal cell and thereafter supplying the first color data to a first liquid crystal cell;

supplying second color data to a third liquid crystal cell and thereafter supplying the second color data to a fourth liquid crystal cell; and supplying third color data to a sixth liquid crystal cell and thereafter supplying the third color data to a fifth liquid crystal cell.

25. The method as claimed in claim 24, wherein the first color is red, the second color is green, and the third color is blue.

* * * * *